US009144259B2

(12) United States Patent
McKinstry

(10) Patent No.: US 9,144,259 B2
(45) Date of Patent: Sep. 29, 2015

(54) ADHESIVE HOLDING SYSTEM

(71) Applicant: Lin Shu-Hui McKinstry, Tustin, CA (US)

(72) Inventor: Lin Shu-Hui McKinstry, Tustin, CA (US)

( * ) Notice: Subject to any disclaimer, the term of this patent is extended or adjusted under 35 U.S.C. 154(b) by 2 days.

(21) Appl. No.: 13/662,540

(22) Filed: Oct. 28, 2012

(65) Prior Publication Data

US 2014/0116460 A1 May 1, 2014

(51) Int. Cl.
*A41G 5/02* (2006.01)
*A44C 9/00* (2006.01)

(52) U.S. Cl.
CPC ..... *A41G 5/02* (2013.01); *A44C 9/0069* (2013.01)

(58) Field of Classification Search
CPC ..... A61C 19/00; A61C 19/006; A41G 5/02; A45D 44/00; A45D 40/30; A61B 2017/00438; A45F 5/00; A45F 2005/008
USPC ..... 224/217, 218; 433/163; 401/8
See application file for complete search history.

(56) References Cited

U.S. PATENT DOCUMENTS 2,858,041 A * 10/1958 Robinson ..... 220/719
5,732,862 A * 3/1998 Bull ..... 224/217

* cited by examiner

*Primary Examiner* — Adam Waggenspack
(74) *Attorney, Agent, or Firm* — Snell & Wilmer LLP

(57) ABSTRACT

A adhesive holding system comprises: a fixed component set in a destined place and a reservoir pedestal having a reservoir well for filling adhesive; it is characterized thereby: at the top of the reservoir well where there is at least one groove; because of the notch, it is easy for user to remove excess adhesive after coating lashes with adhesive. A second and smaller reservoir disk which has a narrower well surface area which prevents the adhesive coming in contact with natural air and atmosphere, therefore eliminating unnecessary waste of adhesive filling, reducing excessive evaporation of the adhesive and resulting in material and quality preservation of adhesive within the reservoir disk. Air flow into the reservoir disk is actually minimized, therefore the reservoir disk will hold the adhesive inside of the disk reservoir without allowing the adhesive to spill out, thus promoting safety and eliminating potential safety hazards.

9 Claims, 5 Drawing Sheets

ADHESIVE HOLDING SYSTEM

FIELD OF THE INVENTION

The present invention relates to an adhesive holding reservoir system particularly to be use with synthetic eyelash extension adhesive, wherein excess adhesive on synthetic eyelashes is easily controlled, provides eyelash extension application safety, application efficiency and adhesive products savings.

BACKGROUND OF THE INVENTION

Eyelashes are a main focal point when it comes to the eyes, which is often enhanced by lengthening or curling the eyelashes to get a more beautiful look of the eyes.

For lengthening eyelashes, the beautician can adhere individual synthetic lashes extension to the human's natural lashes. When applying synthetic lash extensions, a special adhesive made specifically for lash extensions must used. It is also very critical to control the adhesive coating amount on the eyelash extension; therefore a special adhesive holder must be used. While varieties of adhesive holders are available by different suppliers, there is a Conventional adhesive reservoir ring which can be sleeved on a human finger, so the user can place the eyelash adhesive in the reservoir and dip the synthetic lash extension into the adhesive for the eyelash extension application.

As shown in FIG. 10, an Conventional adhesive reservoir ring 9 for synthetic eyelash extension application comprises: a C-shaped sleeve 91 for encompassing a human finger; and an reservoir pedestal 92 set at the top of the C-shaped sleeve, at the top of pedestal there is a reservoir well 93 for holding the adhesive; through the C-shaped sleeve encompassing the human finger, the user can dip the lash extension with adhesive 3.

However, this conventional adhesive reservoir ring has several negative issues due to the fixed depth and fixed area that cannot be changed, therefore much excess waste of the adhesive usually results, it is difficult for the synthetic eyelash extensions to reach the adhesive for proper & necessary adhesive coating, and also serious safety hazard problems can be caused. The negative issues will be described as follows:

Object 1: Too Deep Reservoir Well—Difficult to Reach Adhesive

1. Eyelash extensions come in different shapes and sizes. Some are more curved in shape, some are straighter in shape; some are longer in length and some are shorter in length, the common length of synthetic lashes range from 4 mm to 17 mm. The eyelash adhesive must evenly coat the synthetic lash in order for it to be bonded correctly onto a human's natural eyelash. Therefore, the reservoir well to fill the adhesive cannot be too deep for eyelash extension to reach the adhesive in the well, or the eyelash extension cannot be properly coated with adhesive. Because of the depth of the reservoir in a Conventional adhesive ring is deep, a user needs to use a greater amount of eyelash adhesive to fill the reservoir, making it possible to dip a lash, but is unnecessary and results in a wasteful amount of eyelash adhesive be used.

Object 2: Safety Hazard

2. While using a conventional adhesive ring, to apply synthetic eyelash extensions, the User wears the adhesive ring very close to the client's eye area, as User must move their hands constantly and in different angles in order to apply the eyelash extensions and create eyelash designs. The change in hand direction varies widely depending on the application angle of the eyes as well as the angle of the adhesive ring on the hand itself. Due to the fixed depth of the conventional ring, the adhesive, must be filled to a level that permits the user a proper eyelash coating, however, the adhesive can then easily flow out or spill out from the ring due to bevel wall. This can cause as very serious safety hazard in that the adhesive can drip into the human eye, skin, or clothes resulting in severe damage and creating a health hazard.

Object 3: Excessive Adhesive Evaporation

3. Eyelash adhesive is a fast drying and setting formula that allows the synthetic lash to bond onto human lashes quickly, typically within 3-25 seconds, furthermore, the adhesive itself will evaporate rapidly once opened and comes in contact with air. A wide surface area of the conventional adhesive ring allows natural air contact between with atmosphere which causes excessive evaporation of the adhesive resulting in material waste within the adhesive ring.

Object 4: Not Suitable for Short Length of Lash Extensions

4. For short eyelash extensions, length range between 4 mm-11 mm, only a small amount of adhesive is actually required. However, a conventional adhesive ring has a deep reservoir well, so when it is filled with small amount of adhesive, it can cause problems to dip the short lash into the adhesive as the reservoir well too deep, the short lash cannot reach the adhesive in the reservoir, therefore a proper coating of lash extensions with adhesive cannot be achieve and a proper bond to the natural lash may not be possible.

Object 5: Insufficient Space to Control Adhesive Coating

5. In a conventional adhesive ring, after User coats the eyelash extension with adhesive, the eyelash normally needs to be dapped or slid along the sidewall of the adhesive well to remove excess adhesive on the lash, for proper eyelash extension application. However, the conventional adhesive ring does not provide sufficient space to allow the User to dap or slide off excess adhesives, User must use additional materials to dap or slide off excessive adhesive which causes more application time and additional expense of product.

SUMMARY OF THE INVENTION

The main object of the present invention is to provide an easy and safe adhesive holding system, wherein it is easy to dip the eyelash extension to get the proper amount of adhesive for eyelash coating which is most important for bonding of the synthetic lash to a natural lash, and to easily remove any excess adhesive on the synthetic eyelash after coating with the adhesive; to provide a safe receptacle system; to reduce the unnecessary drying out of adhesive; and to reduce the amount of adhesive waste.

For achieving above object the present invention comprises: a fixed component set in a designated place, a reservoir pedestal having a bottom component set at the top of the fixed component, and a sidewall circling around said bottom component and combining, that together with a reservoir well for holding adhesive; it is characterized thereby: at the top of the sidewall of the reservoir pedestal at least one groove is utilized; as a user can easily take the coated eyelashes to dab, drag or slide onto the groove, until the excess adhesive is removed and achieve the optimal adhesive coating control of synthetic. lashes.

Background Object 1: Too Deep Reservoir Well—Difficult to Reach Adhesive

Object of Present Invention: Adhesive Reservoir Disk Added to Raise Height

Another object of the present invention is to provide an adhesive reservoir disk; this reservoir disk helps elevate the overall adhesive level in the adhesive well, therefore requiring much less adhesive to fill the entire reservoir disk. This also allows easier reach of the adhesive and creates an optimal and preferred well height for dipping synthetic lashes into adhesive.

For achieving above objects the present invention is characterized thereby: in the reservoir well of the reservoir pedestal there is a second adhesive reservoir disk, which is thinner than the depth of the reservoir well of the reservoir pedestal, so that when even a tiny amount of adhesive is used, the adhesive will reach an optimal surface height for proper dipping, of synthetic lashes extension.

Background Object 2: Safety Hazard

Object of Present Invention: Using Adhesive Reservoir Disk

A further object of the present invention is to provide an adhesive reservoir disk for promoting safety when applying synthetic eyelashes; due to the small surface space of the reservoir disk, the air flow into the reservoir disk is actually minimized, therefore the reservoir disk will hold the adhesive inside of the disk reservoir without allowing the adhesive to spill out, so when the User wears the adhesive ring very close to a client's eye area while moving their hands in different angles to apply eyelash extension designs, the adhesive will not spill out, thus promoting safety and eliminates potential safety hazards such as the adhesive dripping, into the human eyes, skin or clothes and create severe damage.

For achieving above object the present invention is characterized, thereby: in the reservoir well of the reservoir pedestal a second reservoir disk is set, wherein the surface area of this second reservoir disk is smaller than that of the larger reservoir well of the main reservoir pedestal; so the adhesive will not spill out, eliminating potential safety hazards and thus promoting safety.

Background Object 3: Excessive Adhesive Evaporation

Object of Present Invention: Proper Size and Depth of Adhesive Disk

Another object of the present invention is to provide an adhesive reservoir disk to reduce adhesive evaporation that causes unnecessary waste of adhesive. Eyelash adhesive must be a fast drying and setting formula that allows the synthetic lash to be bonded onto human lashes quickly, within 3-25 seconds. Due to the natural characteristics of the adhesive, it evaporates rapidly once opened and comes in contact with air. The present invention wherein a reservoir disk is set within the reservoir well, a narrower surface area of the reservoir disk prevents the adhesive to come in contact with natural air and atmosphere which will therefore reduce excessive evaporation of the adhesive, resulting in material and quality preservation of adhesive within the reservoir disk. Thus evaporation in the reservoir disk well of the reservoir pedestal is reduced, eliminating adhesive refilling and also increasing procedure efficiency.

For achieving above objects the present invention is characterized as follows: in the reservoir well of the reservoir pedestal a second smaller reservoir disk is set, whose surface area is smaller than that of the reservoir well of the reservoir pedestal, the actual contact area between adhesive and atmosphere is greatly reduced, and thus evaporation of adhesive is also reduced.

Background Object 4: Not Suitable for Short Length of Lash Extensions

Object of Present Invention: Proper Size and Depth of Reservoir Disk

Another object of the present invention is to provide an adhesive reservoir disk to provide the optimal depth for coating short length synthetic lashes. For shorter eyelash extensions, with a lash length range between 4 mm-11 mm, only a small amount of adhesive is actually required. Too much adhesive in the reservoir well caused excessive coating of the synthetic lash creating improper bonding to the natural lash. The present invention wherein a reservoir disk is set within the reservoir well, because the actual well depth of the reservoir disk is reduced, proper coating of the shorter synthetic lash is accomplished each time. For achieving above objects the present invention is characterized as follows: in the reservoir well of the reservoir pedestal a second thinner & smaller reservoir disk is set, whose surface well depth is reduced, so the actual contact depth in the adhesive well is optimized for adhesive coating with these smaller lashes.

Background Object 5: Insufficient Space to Control Adhesive Coating

Object of Present Invention: Grooves Added to Adhesive Well Top

Another object of the present invention is to provide grooves or notches on the top and/or side of the adhesive ring which provides proper room and space for adhesive coating control and promotes additional procedure safety. You can use the grooves to dab and/or slide off excess adhesive to control the proper coating of adhesive onto synthetic eyelash extensions.

The Groove has a narrow space opposite the reservoir well to prevent adhesive spill out from ring, with the groove gradually widening towards the inner bevel wall which allows any excessive adhesive to flow back to the inner reservoir, the groove serves the function for adhesive coating control and preventing excess adhesive spilling out from the ring, thus promoting procedure safety.

For achieving above objects the present invention is characterized as having "V" or other shaped grooves and/or notches which allow the User to be able to easily control the adhesive coating amount onto synthetic lash, the grooves also provide space, safety and provides User an optimal view necessary for adhesive coating control, by allowing User to easily dap and/or slide off excess adhesive before applying synthetic eyelashes onto the human natural lashes. The User will not need to use any additional materials or objects to dab, and/or slide off excess adhesives to control the proper coating amount of adhesive on the synthetic eyelash extension.

Other aspects and advantages of the present invention will become apparent from the following detailed description, taken in conjunction with the accompanying drawings, illustrating by way of example the principles of the present invention.

DESCRIPTION OF THE PREFERRED EMBODIMENTS

Figure 1:
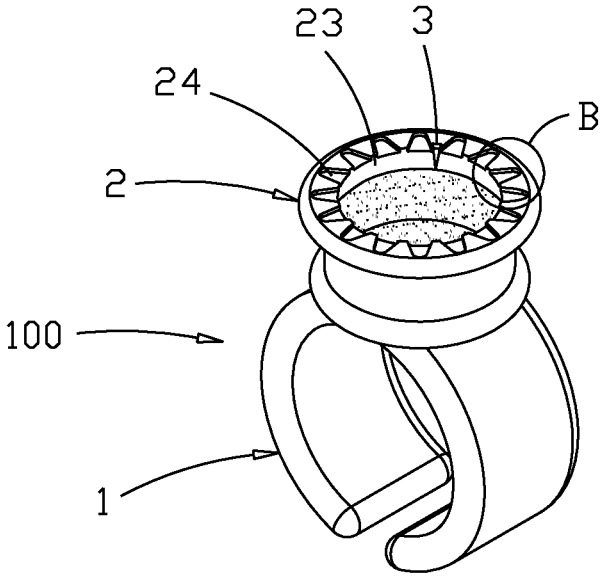
FIG. 1 is a perspective view of the present invention.

FIGS. 1~4 refers to the first embodiment of the present invention. As shown in FIG. 1, an adhesive holding system 100 comprises: a fixed component 1 set in a designated place and a reservoir pedestal 2 having a reservoir well 23 for filling adhesive 3; it is characterized as follows: at the top of the reservoir pedestal 2 at least one groove 24 is set; due to this groove 24 of the reservoir pedestal 2 it is much easier to control and remove excess adhesive off lash after dipping into adhesive.

The fixed component 1 is to be fixed on a human hand (like finger, wrist or any other part) or any part for easy coating adhesive. For an explanation, only one embodiment is described. The fixed component 1 is a C-shaped sleeve for encompassing, a finger therein, so that the user can easily coat lashes with adhesive.

Figure 2:
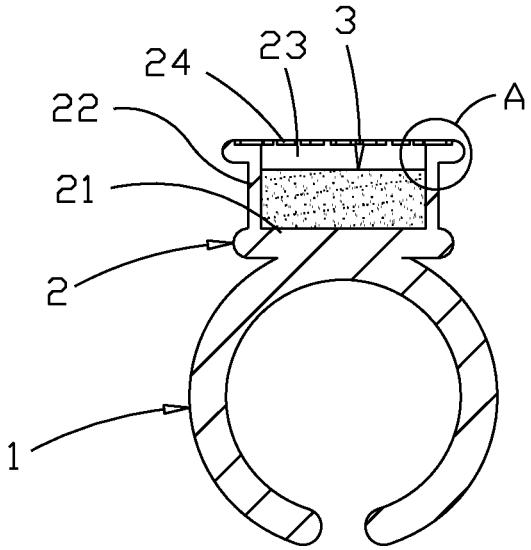
FIG. 2 is a sectional view of the present invention.

As shown in FIG. 2, a reservoir pedestal 2 comprises: a bottom component 21 set at the top of the fixed component 1 and a sidewall 22 circling around said bottom component 21 and building together with the bottom component 21 a reservoir well 23 for filling adhesive 3; It is characterized thereby: at least one groove 24 is set at the top of the sidewall 22 of the reservoir pedestal 2; after a user has put one end of the lash in the reservoir well 23 of the reservoir pedestal 2 and coated the lash with adhesive 3, the lash is moved along the groove 24 of the reservoir pedestal 2, so that the user can easily remove any excess adhesive or even re-dip lash back into adhesive in order to control the exact amount of adhesive that she/he desires on the lash.

Figure 3:
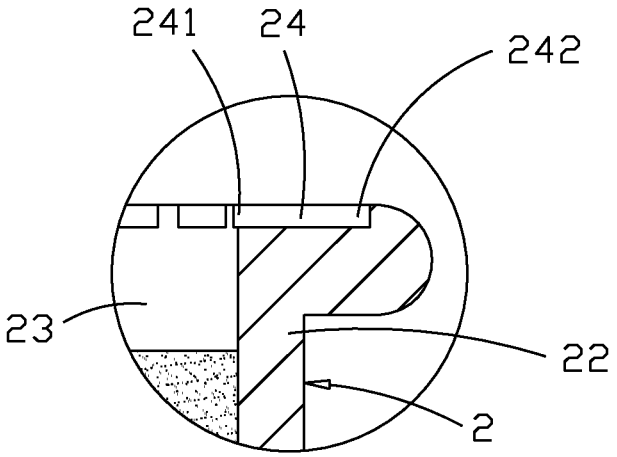
FIG. 3 is an enlarged view of the A-part in the FIG. 2.

As shown in FIG. 3, for explanation the groove 24 of the reservoir pedestal 2 nearing inside as well as outside of the sidewall 22 is defined as groove inside 241 and groove outside 242 respectively. The groove inside 241 is connected with the reservoir well 23 of the reservoir pedestal 2, so the excessive adhesive can easily flow back into the reservoir well 23 of the reservoir pedestal 2.

Figure 4:
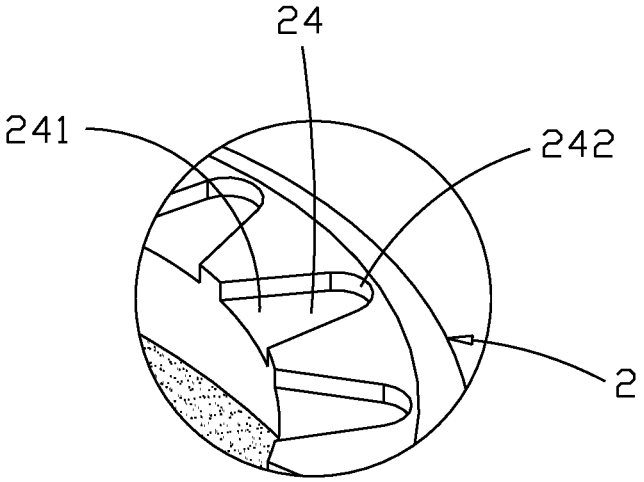
FIG. 4 is an enlarged view of the B-part in the FIG. 1.

As shown in FIG. 4, the groove 24 of the reservoir pedestal 2 gradually narrows from the groove inside 241 to the groove outside 242, so that the adhesive amount on the lashes is easily controlled from the groove inside 241 to outside and provides User with the best and convenient view for proper adhesive coating control.

Figure 5:
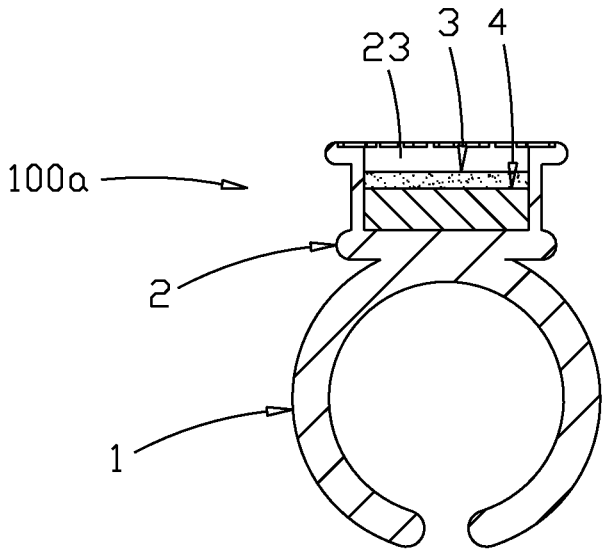
FIG. 5 is a sectional view of the second embodiment of the present invention.

FIG. 5 shows the second embodiment of the present invention, an adhesive holding system 100*a* comprises: a fixed component 1 and a reservoir pedestal 2; it is characterized thereby: a reservoir disk 4, which is thinner than the depth of the reservoir well 23 of the reservoir pedestal 2, is set in the reservoir well 23 of the reservoir pedestal 2, so that the reservoir well is shallower. For proper adhesive coating with shorter lashes length ranging from 4 mm-11 mm, a reservoir disk 4 is put in the reservoir well 23 of the reservoir pedestal 2 at first, so that adhesive in reduced amounts will also reach a desired surface height in the reservoir well.

Figure 6:
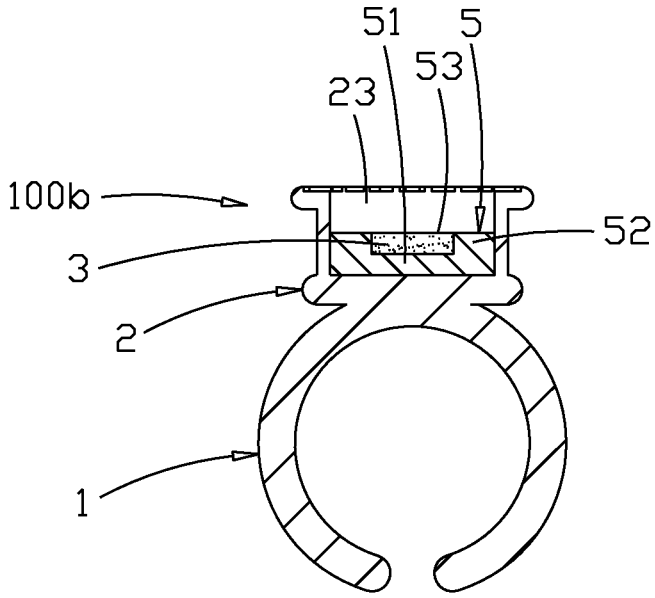
FIG. 6 is a sectional view of the third embodiment of the present invention.

FIG. 6 shows the third embodiment of the present invention. An adhesive holding system 100*b* comprises: a fixed component 1 and reservoir pedestal 2; it is characterized by: a second reservoir disk 5 comprising a second bottom component 51 set in the reservoir well 23 on the reservoir pedestal 2, and a second sidewall 52 circling around the second bottom component 51 and building together with this second bottom component a second reservoir well 53 for filling adhesive 3.

The surface area of the second reservoir well 53 of the second filling reservoir disk 5 is smaller than that of the reservoir well 23 of the reservoir pedestal 2, thus the following objects are achieved:

1. Adhesive easily adheres to the second reservoir well 53 of the second reservoir disk 5, so possible outflow of adhesive caused by bevel is prevented, thus promoting safer eyelash application services.

2. The contact area with natural air between the adhesive and atmosphere is greatly reduced, so that adhesive evaporation is thus reduced, 3. Even if a small amount of adhesive (1 drop to 2 drops or less) is put in the reservoir disk well 53 of the reservoir pedestal, a desired depth of the adhesive in the reservoir well is still achieved.

Figure 7:
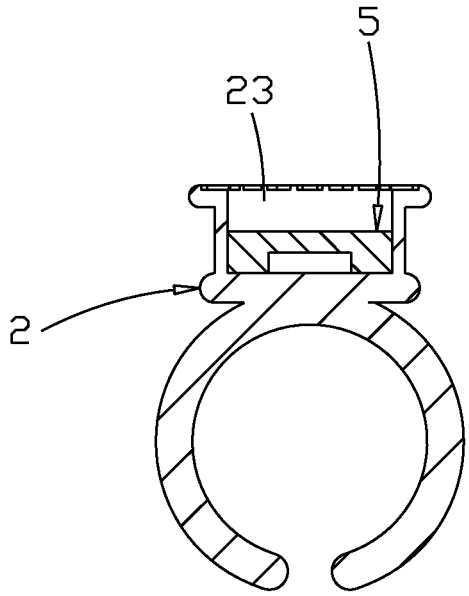
FIG. 7 is a sectional view of the second reservoir disk of the third embodiment of the present invention, wherein the second reservoir disk is upset.

As shown in FIG. 7, since the bottom of the second reservoir disk 5 is flat, when it is upside down in the reservoir well 23 of the reservoir pedestal 2, a reduced amount of adhesive put in the reservoir well can also reach a desired surface height of the adhesive.

Figure 8:
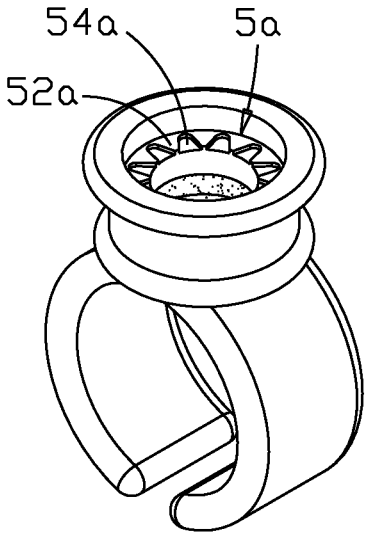
FIG. 8 is a perspective view of the fourth embodiment of the present invention.

FIG. 8 shows the fourth embodiment of the present invention. At the top of a second sidewall 52*a* of a second reservoir disk 5*a* there is at least one second groove 54*a*, which has the same effect as the notch 24 of the reservoir pedestal 2 in the first embodiment, for removing excess adhesive.

Figure 9:
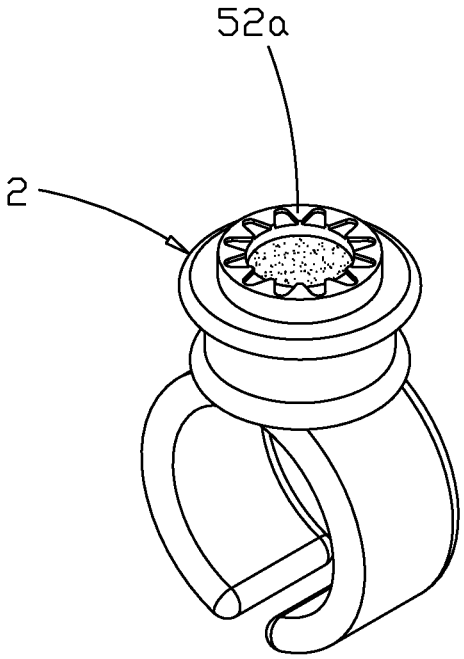
FIG. 9 is a perspective view of the fifth embodiment of the present invention.
Figure 10:
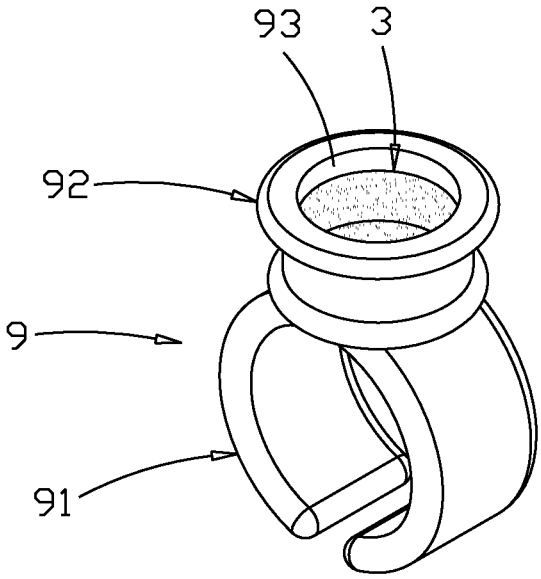
FIG 10 (PRIOR ART)
FIG. 10 is perspective view of a conventional adhesive reservoir ring.

FIG. 9 shows the fifth embodiment of the present invention. The top part of the second sidewall 52*a* is projected from the top part of the reservoir pedestal 2, so that the user can easily coat lashes with adhesive, as well as remove any excess adhesive on lashes through the notch of the second sidewall.

While preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

The invention claimed is:

1. An adhesive holding system comprising:

a fixed component for encompassing a part of a human hand therein, and having a top surface; and a reservoir pedestal including:

a round bottom portion connected to the top surface of the fixed component, a cylindrical sidewall having an outer radius and an inner radius, and connected to and positioned on the round bottom portion and forming with the round bottom portion a reservoir well for containing an adhesive, and a round hollow top portion connected to and positioned on the cylindrical sidewall, having an inner radius that is substantially the same as the inner radius of the cylindrical sidewall and an outer radius that is greater than the outer radius of the cylindrical sidewall, and including a plurality of open reservoirs positioned equidistantly around the round hollow top portion, each open reservoir having a radially outer closed end, a radially inner open end, a bottom surface, and two open reservoir sidewalls, the two open reservoir sidewalls and the bottom surface connecting the outer closed end to the inner open end, the open reservoir being substantially "V" shaped and configured to allow a user of the adhesive holding system to dip an artificial eyelash in the adhesive of the reservoir well and slide the artificial eyelash from the radially inner open end towards the outer closed end.

2. The adhesive holding system of claim 1, wherein the plurality of open reservoirs are connected with the reservoir well.

3. The adhesive holding system of claim 1, wherein the fixed component is a C-shaped sleeve for encompassing a human finger therein.

4. The adhesive holding system of claim 1, wherein the plurality of open reservoirs are positioned at a top surface of the round hollow top portion.

5. The adhesive holding system of claim 1, wherein the round bottom portion has an outer radius that is greater than the outer radius of the cylindrical sidewall.

6. An adhesive holding system comprising:

a fixed component for encompassing a part of a human hand therein, and having a top surface; and a reservoir pedestal including:

a round bottom portion connected to the top surface of the fixed component, a cylindrical sidewall having an outer radius and an inner radius, and connected to and positioned on the round bottom portion and forming with the round bottom portion a reservoir well for containing an adhesive, and a round hollow top portion connected to and positioned on the cylindrical sidewall, having an inner radius that is substantially the same as the inner radius of the cylindrical sidewall and an outer radius that is greater than the outer radius of the cylindrical sidewall, and including a plurality of open reservoirs positioned equidistantly around the round hollow top portion, each open reservoir having a radially outer closed end, a radially inner open end, a bottom surface, and two open reservoir sidewalls, the two open reservoir sidewalls and the bottom surface connecting the outer closed end to the inner open end, the open reservoir being substantially "V" shaped and configured to receive the adhesive from the reservoir well and allow the adhesive to flow back to the reservoir well.

7. The adhesive holding system of claim 6, wherein the fixed component is a C-shaped sleeve for encompassing a human wrist therein.

8. The adhesive holding system of claim 6, wherein the fixed component is a C-shaped sleeve for encompassing a human finger therein.

9. The adhesive holding system of claim 1, wherein the fixed component is a C-shaped sleeve for encompassing a human wrist therein.

* * * * *